US006671988B2

(12) United States Patent
Cyrluk

(10) Patent No.: US 6,671,988 B2
(45) Date of Patent: Jan. 6, 2004

(54) MODULAR COMPONENT HANGING STORE DISPLAY WITH IMPROVED VERSATILITY, ADAPTABILITY AND COST EFFECTIVENESS

(76) Inventor: Issac Cyrluk, 150 Fifth Ave., Hawthorne, NJ (US) 07506

( * ) Notice: Subject to any disclaimer, the term of this patent is extended or adjusted under 35 U.S.C. 154(b) by 0 days.

(21) Appl. No.: 09/876,213

(22) Filed: Jun. 8, 2001

(65) Prior Publication Data

US 2002/0184806 A1 Dec. 12, 2002

(51) Int. Cl.[7] ..... G09F 7/22
(52) U.S. Cl. ..... 40/617; 40/618
(58) Field of Search ..... 40/617, 618

(56) References Cited

U.S. PATENT DOCUMENTS 5,499,789 A * 3/1996 Rose ..... 40/617
5,649,379 A * 7/1997 Hoffman et al. ..... 40/617
6,474,009 B2 * 11/2002 Hahn ..... 40/617

* cited by examiner

*Primary Examiner*—Gary Hoge
(74) *Attorney, Agent, or Firm*—Rothwell, Figg, Ernst & Manbeck

(57) ABSTRACT

A store display enabling improved structure, versatility, adaptability and/or cost effectiveness is provided. The store display includes a base sheet and a frame. The base sheet is preferably fabricated independently of the frame. The frame is preferably extruded. The base sheet is preferably molded (e.g., injection molded or extruded) and then cut to a desired size. After the sheet is formed, engaging tabs are punched along the side edge sheet. The frame includes a receiving channel having tangs that engage the engaging tabs.

23 Claims, 8 Drawing Sheets

MODULAR COMPONENT HANGING STORE DISPLAY WITH IMPROVED VERSATILITY, ADAPTABILITY AND COST EFFECTIVENESS

BACKGROUND OF THE INVENTION

1. Field of the Invention

The present invention relates generally to store displays and, more particularly, to hanging store displays for providing product and/or service information and/or other information to customers.

2. Discussion of the Related Art

In commercial establishments, information is often presented to customers via store displays, including hanging store displays. These hanging store displays include, for example, wall-mounted displays and non-wall-mounted displays that hang from a ceiling distant from a wall area. Hanging displays are often used, for example, in grocery stores, drug stores, department stores and the like. In some establishments, hanging displays are located along or in front of isles of product (e.g., food product, etc.) and above the customer's head-level (i.e., customers may walk under the hanging displays). The displayed information can include, for example, product informations (such as prices, dates, product sources, product characteristics and qualities, advertising, etc.), store information (such as hours of operation, sales information, advertising, etc.), and/or other information.

Typically, this information is replaced, updated and/or changed relatively frequently. For example, product information may need to be changed monthly, weekly, daily, etc., or may need to be changed to accommodate new sales information and/or or other information as needed. The information displayed may be provided, for example, by the commercial establishment and/or by another entity (e.g., an entity or source that sells its product via that commercial establishment). New information to be displayed often has different space requirements and display-type requirements.

Management of displays can be problematic and time consuming. Often, existing systems are costly (e.g., especially where costs are incurred on a multi-store basis, such as for national or regional retailers or chain stores) and have limited versatility and adaptability.

SUMMARY OF THE INVENTION

A store display enabling improved versatility, adaptability and/or cost effectiveness is provided. In preferred embodiments, the store display includes a base sheet, a frame and information media supported thereon. The base sheet is preferably fabricated independently of the frame. The base sheet is preferably molded (e.g., injection molded or extruded) and then cut to a desired size. Preferably, after the base sheet is formed, engaging tabs are punched along side edges of the base sheet. The frame is preferably extruded and formed with a receiving channel that engages with the engaging tabs. The information media can include a separate display placard or the like and/or indicia, graphics or the like formed directly on the base sheet.

The above and other aspects will be further appreciated upon review of the following detailed description of the preferred embodiments and claims.

BRIEF DESCRIPTION OF THE DRAWINGS

The preferred embodiments of the present invention are shown by way of example and not limitation in the accompanying drawings, in which.

DETAILED DESCRIPTION OF THE PREFERRED EMBODIMENTS

Figure 2A:
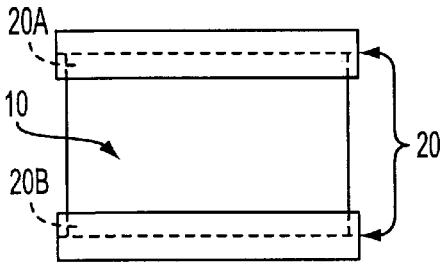
FIG. 2(A) is a front view of a display according to one embodiment having upper and lower frame members.
Figure 2B:
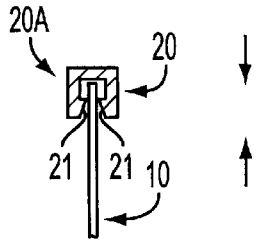
FIG. 2(B) is a side view of a portion of the display shown in FIG. 2(A)
Figure 2C:
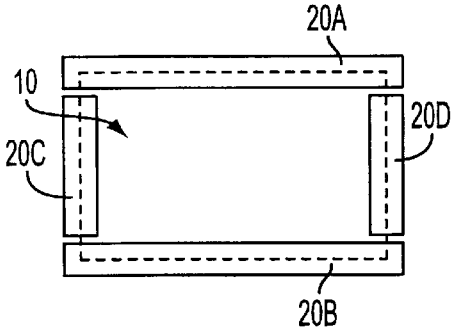
FIG. 2(C) is a front view of a display according to another embodiment having upper, lower, left and right frame members.
Figure 2D:
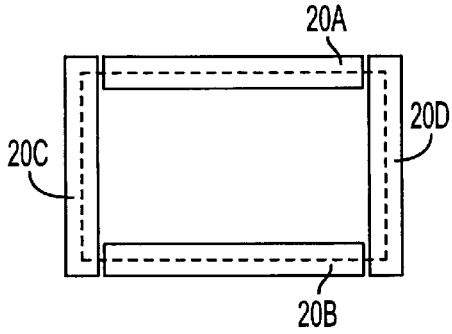
FIG. 2(D) is a front view of a display according to another embodiment having upper, lower, left and right frame members.
Figure 2E:
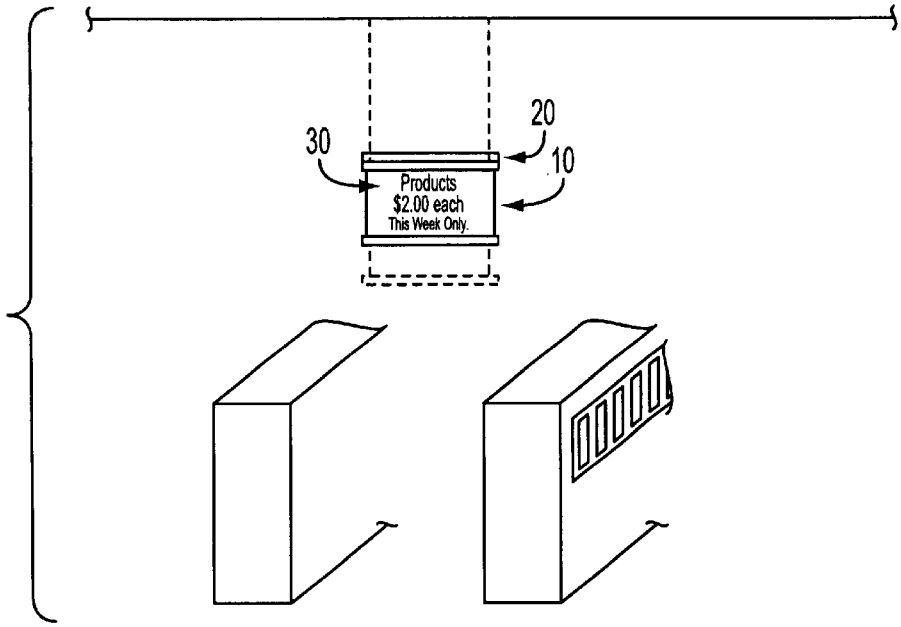
FIG. 2(E) is a perspective view of a display according to one embodiment, hanging from a ceiling proximate product display shelves along isles in a commercial establishment.

In preferred embodiments of the invention, as shown in the illustrative example shown in FIG. 2(E), a hanging store display includes a base sheet 10, a frame 20 and information media 30. The base sheet 10 preferably includes a generally flat sheet that provides a base for the information media 30. The frame 20 preferably creates an aesthetic display border and also preferably includes support elements such as, for example: a) means for supporting the information media (e.g., channels for supporting placards or the like); b) means for attaching additional display elements; and c) means for mounting or hanging the display from a ceiling, wall or the like. In some embodiments, the information media 30 can include indicia and/or ornamentation formed (e.g., printed or the like) directly on the base sheet and/or a separate sheet (e.g., poster, placard, paper sheet or the like) supported over the base sheet containing such indicia and/or ornamentation.

1. Base Sheet

Figure 1A:
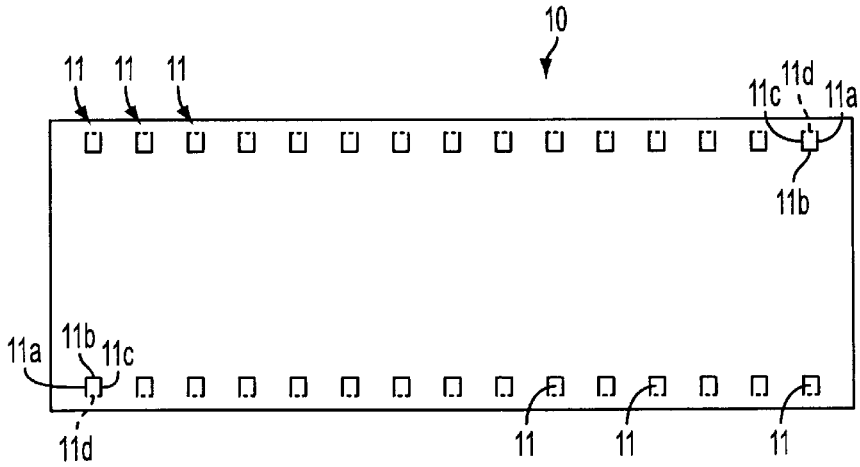
FIG. 1(A) is a plan view of a base sheet according to one embodiment.
Figure 1B:
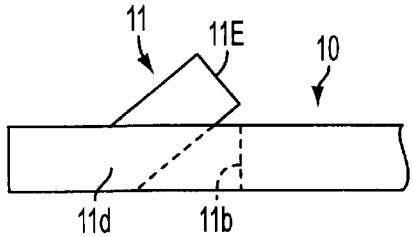
FIG. 1(B) is an exploded side view of a portion of the base sheet shown in FIG. 1(A)
Figure 1C:
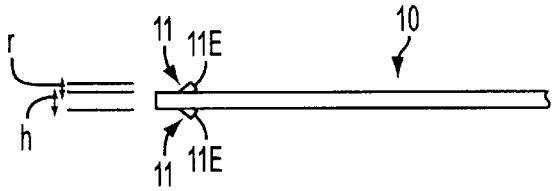
FIG. 1(C) is a side view of a portion of the base sheet shown in FIG. 1(A)

An illustrative embodiment of the base sheet 10 is shown in FIGS. 1(A) to 1(C). Preferably, the base sheet 10 is a generally rectangular sheet. In preferred embodiments, the sheet is formed from molded plastic material. In alternative embodiments, the sheet can be made from other materials, such as natural paper (e.g., made from trees or other plants, etc.) and/or synthetic paper, corrugated board and/or cardboard, metals and/or other appropriate materials.

Figure 1D:
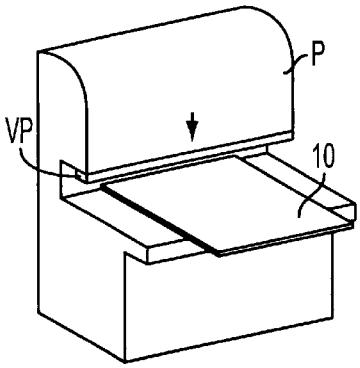
FIG. 1(D) is a perspective view of a press that can be used to form tabs in the base sheets.
Figure 1E:
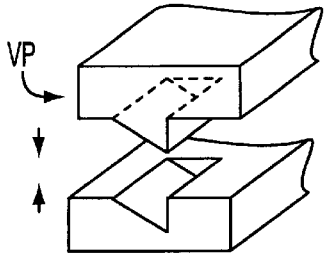
FIG. 1(E) is a partial perspective view of a vertical punch for forming tabs according to one embodiment.
Figure 1F:
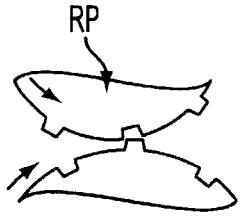
FIG. 1(F) is a partial side view of a rotary punch for forming tabs according to another embodiment.

As shown in FIG. 1(A), the base sheet 10 preferably includes a plurality of tabs 11 that are formed along the base sheet 10. The tabs are preferably formed by cutting the base sheet along lines 11*a,* 11*b* and 11*c* and bending the base sheet along line 11*d*. As illustrated in FIGS. 1(D) to 1(F), this is preferably done via a press P having a vertically reciprocated punch VP or a rotary punch RP subsequent to the formation of the base sheet. In this manner, the tabs 11 provide a locking end 11E protruding outward from the surface of the base sheet 10.

The base sheet 10 preferably includes a plurality of tabs 11 along at least the upper and lower sides. Preferably, a plurality of tabs extend upward and a plurality of tabs extend downward to provide protruding locking ends 11E above and below the base sheet 10, as shown for example in FIG. 1(C). Preferably, tabs extend upward and downward on an alternating basis.

The embodiment shown in FIG. 1(A) is preferably used with a frame 20 having upper and lower frame members. However, other embodiments can include different numbers of frame members. For example, a simple basic embodiment can be formed with a single upper frame member. And, other embodiments can include side frame members attached at left and/or right sides of the sheet 10 (see, e.g., FIGS. 2(C) and 2(D)). Preferably, the base sheet include tabs 11 along peripheral edges upon which the frame members are connected (e.g., typically, generally horizontal and/or generally vertical frame members will be used along top, bottom, left and/or right edges of the sheet).

While the base sheet can have a variety of sizes and shapes, in some illustrative embodiments a base sheet can have any of the following exemplary dimensions, each having some advantages in certain applications:

1. 12, 24, 36 or 48 inches wide by 24 inches high; or
2. 12, 24, 36 or 48 inches wide by 18 inches high; or
3. 12, 24, 36 or 48 inches wide by 12 inches high; or
4. 12, 24, 36 or 48 inches wide by 6 inches high; or
5. 12, 24, 36 or 48 inches wide by 4 inches high; or
6. 12, 24, 36 or 48 inches wide by 3 inches high.

In some illustrative and non-limiting embodiments, the base sheet can be formed from a plastic material and can have a thickness h, FIG. 1(C), between about 0.05 to 0.2 inches, or more preferably between about 0.75 to 1.5 inches, or more preferably between about 0.1 to 0.125 inches, and the distance that the tabs 11 extend outward can preferably between about 0.04 to 0.1 inches, or more preferably between about 0.06 to 0.08 inches. In other embodiments, the dimensions can be selected based on circumstances.

2. Frame

A first illustrative embodiment of the frame 20 is shown in FIGS. 2(A) and 2(B). As shown in FIG. 2(A), the frame 20 preferably includes at least a top frame member 20A and a bottom frame member 20B. The frame members 20A and 20B preferably include like means for connecting to the base sheet 10. As shown in FIG. 2(B), the frame member 20A, for example, preferably includes a channel having inwardly facing tangs 21 extending lengthwise along the frame member. In this manner, the frame member 20A can fit over an edge of the base sheet 10 with the tabs 11 received inside the channel and the locking ends 11E locked behind the tangs 21. Preferably, the tabs and/or the frame members are flexible and resilient to allow the tabs to snap-fit into the respective channels when the sheet 10 is inserted into the channels of the frame members in the direction of the arrows A and B shown in FIG. 2(B). In less preferred embodiments, the channels can be slid laterally over the edges of the base sheet to engage the base sheet 10 and the frame members 20A, 20B.

FIG. 2(C) shows an embodiment wherein the frame 20 includes an upper cross-member 20A, a bottom cross-member 20B, a left side-member 20C and a right side-member 20D. The left and right side members 20C and 20D preferably attach to the base sheet 10 in a similar manner to that of the upper member 20A and the bottom member 20B. In this embodiment, the bottom cross-member 20B can advantageously inhibit the left and/or right side-members from sliding off of the display when it is hung vertically.

As shown in FIGS. 3(A) to 3(G), the various frame members can have a variety of configurations depending on circumstances. Each of the frame members can be selected to meet the particular needs at hand. Preferably, if a display is to be altered, one or more of the frame members can simply be separated from the base sheet 10 and a new frame member can be provided. The modular structure also preferably enables new base sheets to be provided and/or new information media to be provided as needed.

Figure 3A:
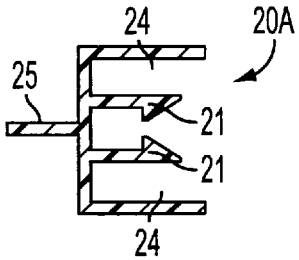
FIGS. 3(A) to 3(H) show frame cross-sections according to illustrative embodiments.
Figure 4:
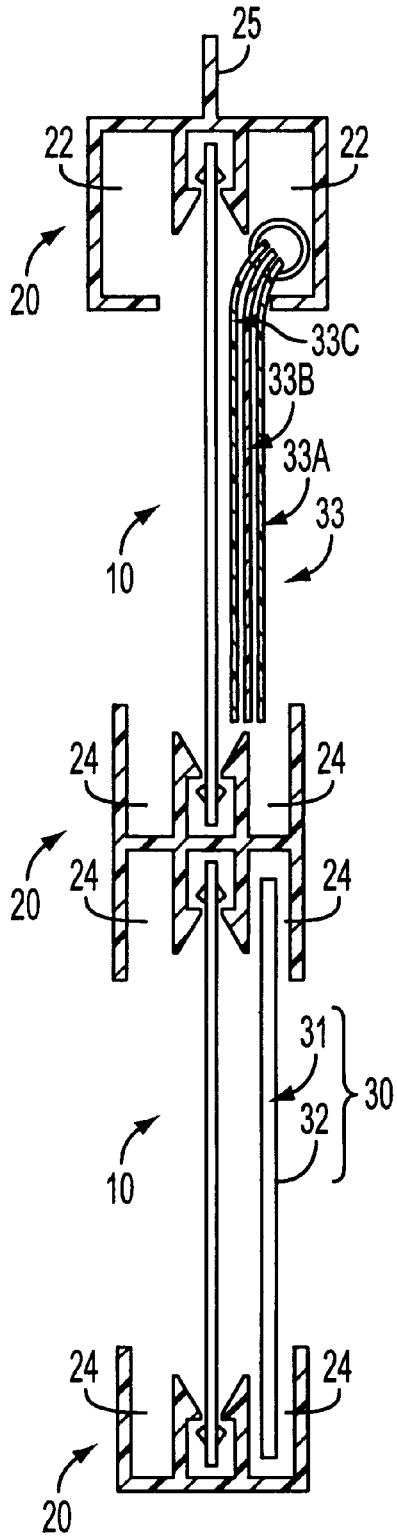
FIG. 4 is a side view of a display according to one illustrative embodiment.

FIG. 3(A) shows a frame member 20A that includes a central receiving channel having tangs 21 to engage with respective tabs 11 in a base sheet, side receiving channels 24 to support information media including a display sheet (see, e.g., placard 31 in FIG. 4). The frame member 20A is, thus, configured to display, if desired, information media on the front and back of the display. The frame member 20A also includes an upwardly extending support flange 25. The support flange 25 can be used to facilitate hanging of the display. Preferably, the flange includes one or more holes through which a hook, chord or other hanging element can pass to support the display.

Figure 3B:
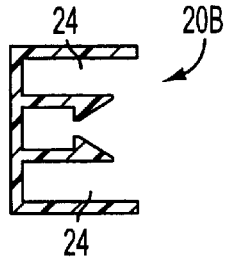

FIG. 3(B) shows a frame member 20B similar to that shown in FIG. 3(A), without the use of the support flange 25.

Figure 3C:
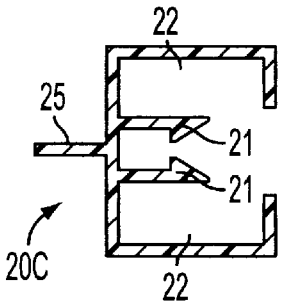

FIG. 3(C) shows a frame member 20C similar to that shown in FIG. 3(A), having booklet binder receiving cavities 22 (i.e., discussed below with reference to FIG. 4). FIG. 3(G) shows a frame member 20G similar to that shown in FIG. 3(C) with a receiving cavity 22 on only one side of the display.

Figure 3D:
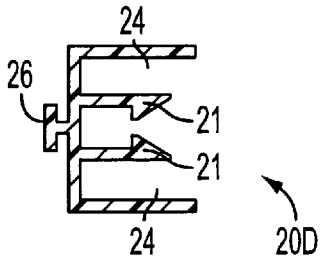

FIG. 3(D) shows a frame member 20D similar to that shown in FIG. 3(A), having a T-shaped support element 26. As with the support flange 25, the T-shaped support element 26 can be used to hang the display—e.g., from an element such as a channel that is configured to engage with the T-shaped support element 26. The flange 25 and the T-shaped support element 26 represent just a few illustrative means for hanging the display. Other means known in the art could be used depending on circumstances. FIG. 3(F) shows a frame member 20F similar to that shown in FIG. 3(D) with a receiving channel 24 on only one side of the display.

Figure 3E:
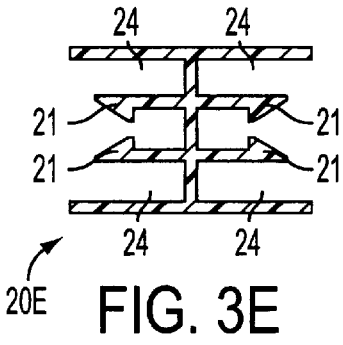
Figure 3F:
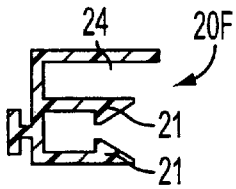
Figure 3H:
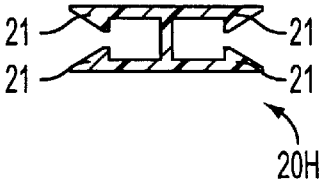
Figure 3G:
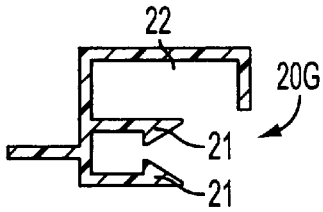

FIG. 3(E) shows a frame member 20E similar to that shown in FIG. 3(A), but configured to operate as a connector between two adjacent base sheets. In this manner, the display can be adapted as desired to include multiple display elements. For example, as shown by dashed lines in FIG. 2(E), a frame member 20E can be used to provide a second, lower display element. Although not illustrated, similar frame members can be used to connect display elements in a side-by-side manner (i.e., as vertical frame members). As shown in FIG. 3(H), connecting frame members can also be provided that omit information media supports (such as, for example, retaining channels and/or cavities 22,24) on one or more sides (e.g., on both sides in FIG. 3(H)). In the latter case, the connecting element can be used to connect a plurality of base sheets together without or with limited obstruction over the base sheets. This can be desirable when, for example, information media is printed directly on the base sheets and/or information media extends over a plurality of base sheets (i.e., either with common indicia or graphics extending over multiple sheets or with a display sheet sized to fit over multiple base sheets and over the connecting frame member). The frame member 20H enables the base sheet dimensions to be varied as needed and, as with other features herein, enhances versatility and adaptability of the display.

While a variety of frame members have been shown and described, various aspects of the frame members can be combined, altered and/or eliminated as needed based on circumstances. In alternative embodiments, a variety of other configurations can be chosen.

3. Information Media

As illustrated in FIG. 2(E), the hanging display includes information media 30. The information media 30 includes displayed information such as, for example, product or service information (such as prices, dates, source identities, characteristics and qualities, promotional information, advertising, etc.), store information (such as hours of operation, sales information, advertising, etc.) and/or other information.

In some embodiments, the information media includes indicia, graphics or the like provided directly upon or within the base sheet 10 (e.g., photocopied, printed, dyed, etc.). For example, the base sheet can be made with colored materials, such as plastics, providing display information.

In some embodiments, the information media includes a placard 31 (see, as one example, FIG. 4) on and/in within which indicia, graphics or the like are provided. In some embodiments, the placard can be formed with a generally rigid material (e.g., cardboard, rigid posterboard, plastics or the like). Preferably, the placard is configured such that it can be retained via retaining channels 21 in the frame 20 without additional attaching means. Preferably, the placard is bendable so that it may be placed in the retaining channels 21 after assembling the base sheet 10 to the frame 20. In some embodiments, the placard can be attached to the base sheet with additional means such as tape, adhesives or the like.

In some embodiments, the information media includes a booklet 33 containing a plurality of sheets (e.g., sheets 33A, 33B, 33C shown in FIG. 4) that are connected via a binder 34, such as a spiral binder. These sheets can be used, for example, to vary pricing as needed (e.g., with each sheet containing a particular number, such as the numbers 0–9, etc.). In the illustrative embodiment shown in FIG. 4, a booklet 33 is provided that has an enlarged binder (e.g., spiral binder) and the frame includes a receiving cavity 22 configured to receive the binder 34. In this latter case, the binder 34 is preferably placed within the cavity by sliding the binder lengthwise into an open end of the cavity 22.

Although a single booklet 33 is shown in FIG. 4, a plurality of booklets may be located within the frame in a side-by-side manner. In this manner, as with various other features herein, versatility and adaptability can be increased. In just one of many illustrative examples, four booklets could be provided with each booklet corresponding to a single-digit number to enable pricing to be varied between $00.00 and $99.99.

4. Multi-Dimensional Displays

Figure 5A:
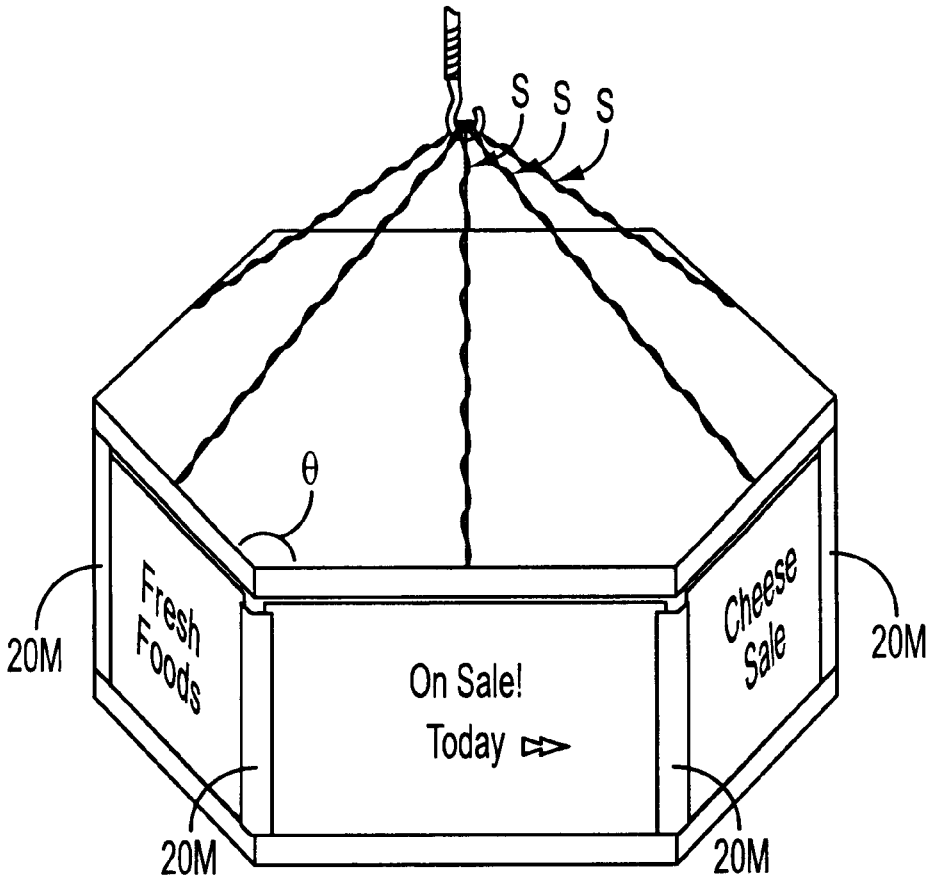
FIG. 5(A) is a perspective view of a display having angled side frame members according to another illustrative embodiment.
Figure 5B:
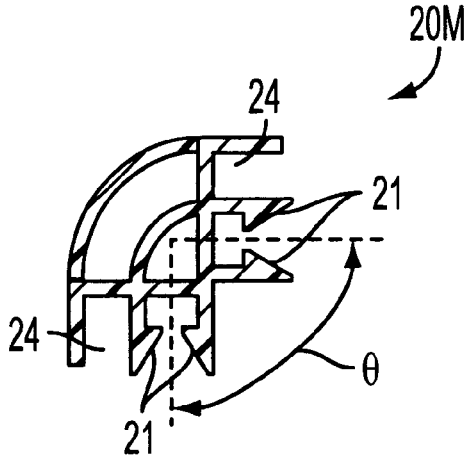
FIG. 5(B) is a cross-sectional view of one of the side frame members shown in FIG. 5(A)

As illustrated in FIGS. 5(A) and 5(B), multi-dimensional displays can be created by providing frame members 20M. The frame members 20M can be generally similar to the frame members 20E shown in FIG. 3(E) with an angle θ of less than 180 degrees so that adjacent base sheets can be attached that are not on the same plain. In this manner, as shown in FIG. 5(A), display elements can be connected in a side-by-side manner with an angle θ formed between adjacent display elements. Preferably, as in the embodiment shown in FIG. 5(B), the frame members 20M only support information media along a convex or outer side (e.g., such as providing channels 24 only on the outer side as shown). The angle θ can be selected as desired. For example, a four-sided display can be created with angles of 90 degrees (e.g., as shown in FIG. 5(B)), a six-sided display can be created with angles of 60 degrees (e.g., as shown in FIG. 5(A)), etc.

In addition to using angled frame members 20M for the generally vertical frame members as shown in FIG. 5(A), angled frame members 20M could be used for the generally horizontal frame members. For example, a completely enclosed cube or box can easily be created using 90 degree frame members 20M for both generally horizontal and generally vertical frame members.

When a multi-dimensional display is provided, it can be readily adapted to rest upon a surface and/or to hang via hanging elements S (e.g., string, cable, hooks and/or the like). Multi-dimensional displays can also include internal illumination sources, such as light bulbs, to enhance the display (e.g., via illumination through the base sheets).

5. Modified Base Sheets

In alternative embodiments, the base sheet 10 can be modified to support additional components.

a. Central Frame Components

Figure 6A:
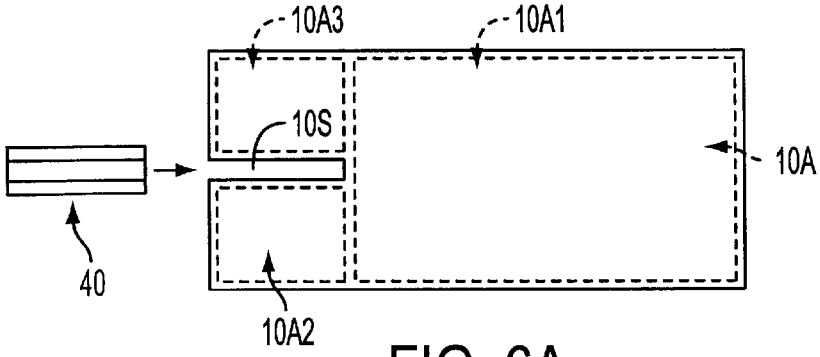
FIG. 6(A) is a front view of a base sheet according to another embodiment wherein a slot is formed in the base sheet to accommodate a slot-mounted display support component.
Figure 6B:
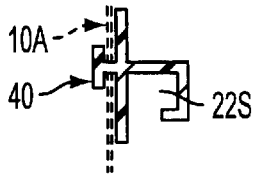
FIG. 6(B) is a side view of the illustrative slot-mounted display support component shown in FIG. 6(A)

As shown in FIG. 6(A), the base sheet 10 can include one or more connector for attaching central frame components. In the illustrative embodiment, a slot 10S is provided as a connector. In alternative embodiments, other connectors could be used (e.g., such as holes, ridges, etc.). The slot 10S can be formed in the base sheet to accommodate a slot-mounted display support component 40. The display support component 40 can have a variety of configurations. Preferably, the component 40 includes means for supporting a predetermined type of information media, such as a booklet, placard or other media. For example, as shown in FIG. 6(B), the component 40 can include a cavity 22S that is configured to support the binder (e.g., a spiral binder) of a booklet (e.g., similar to cavity 22 in FIG. 4). In this manner, a single base sheet 10 as shown in FIG. 6(A) can be used to support a single placard or the like (i.e., covering the entire surface of the base sheet and the slot 10S) or can be used to provide separate display components over the regions 10A1, 10A2 and/or 10A3 shown in dashed lines in FIG. 6(A). This latter embodiment can be advantageous, for example, to display prices (e.g., within region 10A2) or the like adjacent product or service information or the like (e.g., within region 10A1).

b. Product Holding Components

Figure 7A:
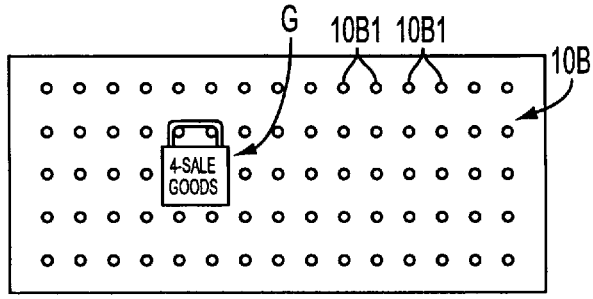
FIG. 7(A) is a front view of a base sheet according to another embodiment wherein an array of through-holes are formed in the base sheet to accommodate holders for retaining product.
Figure 7B:
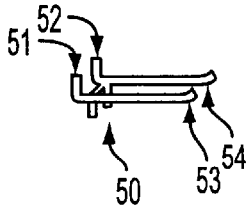
FIG. 7(B) is a perspective view of the illustrative holder shown in FIG. 7(A)

As shown in FIG. 7(A), the base sheet 10 can include one or more connector for holding product. In the illustrative embodiment, an array of through-holes 10B1 is provided in the base sheet 10 that accommodate holders for retaining product. An illustrative holder 50 is shown in FIG. 7(B). The holder shown in FIG. 7(B) includes rear prongs 51 and 52 that can fit within holes 10B1 and forward prongs 53 and 54 that can retain product G as shown in FIG. 7(A). In alternative embodiments, other connectors and product holders could be used, such as clips, pins, tape, adhesive, etc.

6. Flexible Frame Members

FIGS. 8(A) to 8(D) illustrate some additional embodiments of the invention including flexible frame members. While a few illustrative embodiments are pictured in these figures, any of the various frame members described in this application and/or other frame members encompassed by this disclosure can be formed with flexible sections as desired.

Among other things, flexible frame members can be provided to enable the formation of: a) multi-sided displays; b) collapsible displays; c) displays adaptable to particular conditions; and/or d) various other advantageous displays. In preferred embodiments, a flexible frame member of a desired configuration is formed from a co-extrusion made with substantially rigid plastic sections co-extruded with a substantially flexible plastic section (e.g., a flexible hinge section) bridging between the substantially rigid plastic sections. Any appropriate substantially rigid and substantially flexible plastic materials known for making co-extrusions, as would be recognized by those in the art based on this disclosure, can be used. In other embodiments, the flexible frame members can be made with other materials and/or via other processes.

Figure 8A:
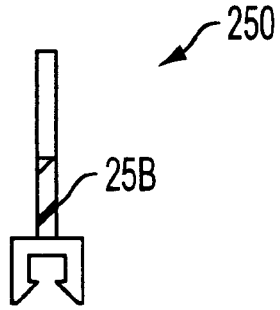
FIGS. 8(A) and 8(B) are cross-sectional views of illustrative frame members having flexible sections.
Figure 8B:
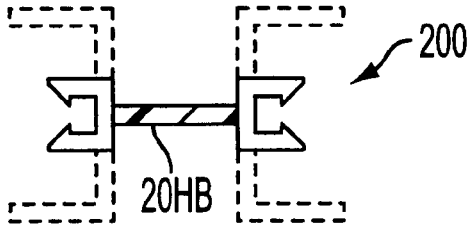
Figure 8C:
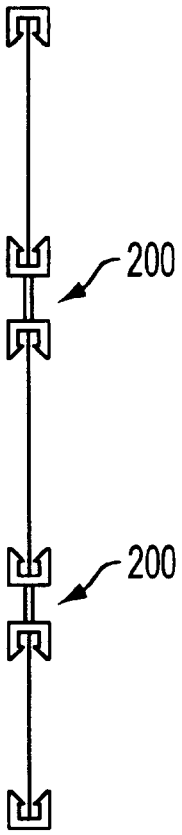
FIG. 8(C) is a side view of a display according to one illustrative embodiment including frame members having flexible sections in an unfolded condition.
Figure 8D:
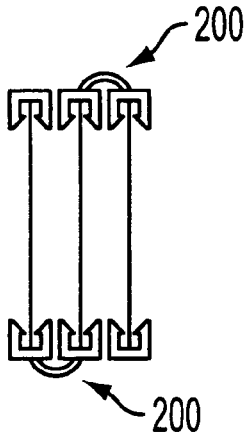
FIG. 8(D) is a side view of a display according to one illustrative embodiment including frame members having flexible sections in a folded condition.
Figure 9:
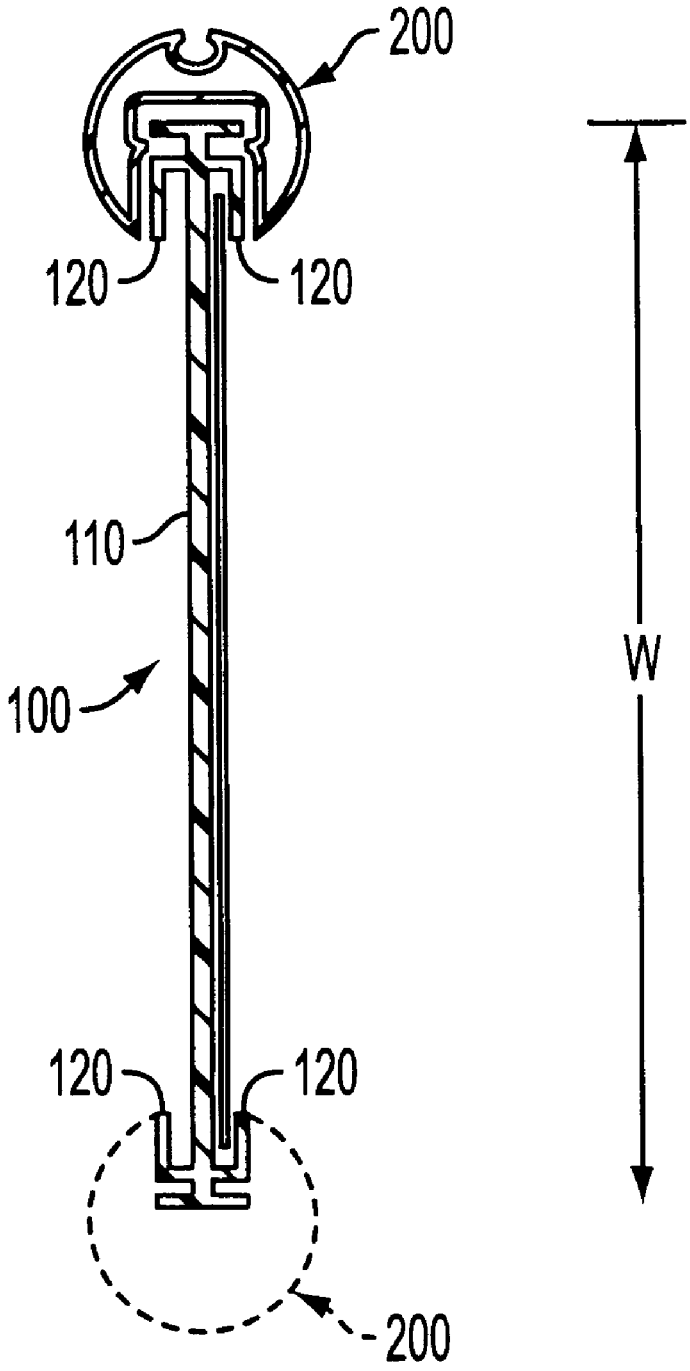
FIG. 9 is a side view of an existing display structure of the present applicant.

The illustrative example in FIG. 8(B) shows a frame member 200 that is generally similar to the member 20H shown in FIG. 3(H) and that includes a flexible section 20HB to facilitate flexure of the frame member. Among other things, this can facilitate handling and/or adaptability. For instance, as shown schematically in FIGS. 8(C) and 8(D), a flexible frame member 200 can be used to allow a display to be folded or collapsed into a compact state for transport (e.g., as shown in FIG. 8(D)) and expanded into a display state for use (e.g., as. shown in FIG. 8(C)). Among other things, this can facilitate pre-assembly of displays at distant locations (e.g., off site). After assembly, the displays can be folded or collapsed to facilitate transport. Then, the displays can be delivered to the respective display sites and unfolded for use. As illustrated in dashed lines in FIG. 8(B), the flexible frame member can include additional portions to facilitate holding display elements or the like (e.g., similar to, for example, the frame member shown in FIG. 3(E)) and/or can be made similar to any of the various frame members shown in FIGS. 3(A) to 3(H) with the addition of a flexible section.

In some embodiments, a flexible frame member can be used to create multi-dimensional displays such as, e.g., illustrated in FIGS. 5(A) and 5(B). In that regard, a flexible section can enable a corner frame member (e.g., similar to 20M) to be set to a desired angle by flexure of the flexible frame member about its flexible section. Accordingly, in some embodiments, substantially identical flexible frame members can be used as corner members in various displays of n sides (e.g., 3, 4, 5, etc., sides).

FIG. 8(A) shows another illustrative example with a display member 250 that is generally similar to the member 20A shown in FIG. 3(A) and that includes a flexible section 25B to facilitate flexure of the frame member. Among other things, this can facilitate hanging, handling and/or adaptability.

7. Versatility. Adaptability And Cost Effectiveness

The various features of the preferred embodiments of the present invention enable a highly versatile and adaptable display. By simply varying a) one or more frame members, b) one or more base sheet (e.g. sizes, etc.), c) information media structure (e.g., direct printing, placards, booklets, etc.) and/or d) information media content (e.g., the advertised information itself), the display can be readily adapted on demand.

The present invention has very significant advantages over existing systems. For example, the applicant's prior hanging display system shown in FIG. 8 included an extruded member 100 having a generally flat portion 110 and upper and lower channels 120 integrally formed on the front and back sides. During the extrusion of the member 100 (i.e., including the portion 110 and the channels 120), there is a substantial variation in size and shape consistency due to the large width W (i.e., increased width results in increased discrepancy during extrusion). Among other things, this result and the problems associated therewith can be overcome by the present invention. In order to enhance the aesthetics of the display, a border B was included. The required border B, however, was somewhat complex and, hence, somewhat costly when produced on a large scale. Moreover, the applicant's previous system lacked the versatility and adaptability of the present invention.

While non-limiting preferred embodiments of the invention have been described in detail herein, the present invention encompasses all modifications, alterations and adaptations as would be apparent to those in the art based on this disclosure and as encompassed by the claims which follow. In just some illustrative modifications, the shapes of the frame members can be modified as desired (e.g., to include a different contour, an ornamental pattern and/or another configuration). Additionally, while displays having generally straight frame members are pictured, various other embodiments can include varied, contoured, rounded or otherwise non-linear frame members. Displays having a variety of sizes and shapes can be made in various embodiments of the invention. In the claims, no limitations are means-plus-function limitations unless expressly defined as such limitations.

What is claimed is:

1. A hanging store display, comprising:

a base sheet having a) a first plurality of projection tabs along a first side of said base sheet and b) a second plurality of projection tabs along a second side of said base sheet;

a first frame member having a base-connection channel connectable with said first plurality of projection tabs;

a second frame member having a base-connection channel connectable with said second plurality of projection tabs; and information media including indicia and/or graphics upon said base sheet.

2. The hanging store display of claim 1, wherein said base-connection channels of said first and second frame members include tangs that fit over the respective tabs.

3. The hanging store display of claim 1, wherein said first frame member is mounted generally horizontally over an upper end of the base sheet and said second frame member is mounted generally horizontally under a lower end of the base sheet.

4. The hanging store display of claim 3, wherein said first and second frame members include media-support channels and said information media includes a display sheet supported within said media-support channels.

5. The hanging store display of claim 4, wherein at least one of said first and second frame members includes means for hanging said display from a wall or ceiling.

6. The hanging store display of claim 5, wherein said frame members are formed from extruded plastic.

7. The hanging store display of claim 6, wherein said base sheet is formed from a stock of sheet material that is cut along one or more side to form the base sheet.

8. The hanging store display of claim 3, wherein said base sheet is formed from plastic.

9. The hanging store display of claim 8, wherein said information media includes indicia and/or graphics formed directly on or in said base sheet.

10. The hanging store display of claim 3, wherein said base sheet is formed from a natural and/or synthetic paper.

11. The hanging store display of claim 10, wherein said information media includes indicia and/or graphics formed directly on or in said base sheet.

12. The hanging store display of claim 1, wherein at least one of said first and second frame members includes a second base-connection channel for attachment to a second base sheet.

13. The hanging store display of claim 12, wherein said base-connection channel is formed at an angle of less than 180 degrees from said second base-connection channel.

14. The handing store display of claim 12, wherein said at least one of said frame members includes a substantially flexible hinge section.

15. The hanging store display of claim 14, wherein said substantially flexible hinge section is co-extruded as an integral section of said at least one of said frame members.

16. A method of displaying information to customers in a commercial establishment with the display of claim 1, comprising:

providing the information media with information related to products or services sold at the commercial establishment; and hanging the display from a wall or ceiling proximate the view of customers in the commercial establishment.

17. The method of claim 16, further including modifying the information displayed by replacing the base sheet with a base sheet having a different size or characteristic.

18. The method of claim 16, further including modifying the information displayed by replacing at least one of the frame members to support different or additional display elements or information media.

19. A method of making the display of claim 1, comprising:

extruding the first frame member via an extrusion die;

extruding the second frame member via an extrusion die; and forming the base sheet and punching said tabs into said base sheet.

20. The method of claim 19, further including forming said base sheet from a plastic material.

21. The method of claim 20, further including cutting the base sheet into a generally rectangular sheet and then punching said tabs into said base sheet.

22. The method of claim 19, further including forming said base sheet from a paper or cardboard material.

23. A hanging store display system, comprising:

a) a base sheet having i) a first plurality of projection tabs along a first side of said base sheet and ii) a second plurality of projection tabs along a second side of said base sheet;

b) a first frame member mounted generally horizontally over an upper end of the base sheet and having:

means for connecting with said first plurality of projection tabs;

means for hanging said hanging store display from a ceiling or wall;

means for supporting information media having at least one sheet extending over said base sheet;

c) said first frame member being made from an integral piece of extruded plastic;

d) a second frame member mounted generally horizontally under a lower end of the base sheet and having:

means for connecting with said second plurality of projection tabs;

means for supporting information media having at least one sheet extending over said base sheet;

e) said second frame member being made from an integral piece of extruded plastic; and f) information media including information related to products or services offered for sale at the store.

* * * * *